US012246265B2

(12) United States Patent
Quinn

(10) Patent No.: US 12,246,265 B2
(45) Date of Patent: Mar. 11, 2025

(54) MAGNETIC CONSTRUCTION BLOCK TOY SET

(71) Applicant: SPARK INNOVATION, LLC, American Fork, UT (US)

(72) Inventor: Reed Quinn, American Fork, UT (US)

( * ) Notice: Subject to any disclaimer, the term of this patent is extended or adjusted under 35 U.S.C. 154(b) by 0 days.

(21) Appl. No.: 18/253,674

(22) PCT Filed: Oct. 16, 2021

(86) PCT No.: PCT/IB2021/059545
§ 371 (c)(1),
(2) Date: May 19, 2023

(87) PCT Pub. No.: WO2022/106929
PCT Pub. Date: May 27, 2022

(65) Prior Publication Data

US 2024/0001253 A1 Jan. 4, 2024

Related U.S. Application Data

(63) Continuation of application No. 16/952,951, filed on Nov. 19, 2020, now abandoned.

(51) Int. Cl.
*A63H 33/10* (2006.01)
*A63H 33/04* (2006.01)

(52) U.S. Cl.
CPC ..... *A63H 33/046* (2013.01)

(58) Field of Classification Search
CPC ..... A63H 33/046
See application file for complete search history.

(56) References Cited

U.S. PATENT DOCUMENTS

2005/0170739 A1* 8/2005 Zoellner ..... A63H 33/046 446/92
2012/0086530 A1* 4/2012 Rathbun ..... H01F 7/0252 335/285

(Continued)

FOREIGN PATENT DOCUMENTS

KR 10-2011-0104143 * 9/2011 ..... A63H 33/046

OTHER PUBLICATIONS

Kim, Machine Translation of KR Pub. No. 10-2011-0104143, uploaded Feb. 28, 2024, Espacenet, 5 pages.*

*Primary Examiner* — Eugene L Kim
*Assistant Examiner* — Matthew B Stanczak
(74) *Attorney, Agent, or Firm* — Superior IP, PLLC; Dustin L. Call

(57) ABSTRACT

A magnetic block set comprising a plurality of magnetically connectable magnetic block units. Each magnetic block unit includes a block body having two or more connection faces. Each connection face includes a plurality of connection face edges and a connection face surface and each connection face is a square. Each magnetic block unit also includes one or more magnetic elements on each of the tow or more connection faces, each magnetic element having a magnetic polarity relative to the connection face that is the same as each of the other magnetic elements on all of the connection faces. Each magnetic block unit further includes an outer shell covering both the block body and each of the one or more magnetic elements. The outer shell includes an indicator of the polarity of the magnetic elements within the magnetic block unit.

10 Claims, 3 Drawing Sheets

(56) References Cited

U.S. PATENT DOCUMENTS

| | | | | |
|---|---|---|---|---|
| 2014/0259266 | A1* | 9/2014 | Federlin | A41F 1/002 2/69 |
| 2016/0108392 | A1* | 4/2016 | Stelling | C12N 15/1013 506/40 |
| 2018/0161687 | A1* | 6/2018 | Naini | A63H 33/088 |
| 2020/0140182 | A1* | 5/2020 | Adjeleian | A47G 23/02 |

* cited by examiner

MAGNETIC CONSTRUCTION BLOCK TOY SET

CROSS-REFERENCE TO RELATED APPLICATIONS

This application claims the benefit of and priority to U.S. Non-Provisional patent application Ser. No. 16/952,951 filed on Nov. 19, 2020, which application is incorporated herein by reference in its entirety.

BACKGROUND OF THE INVENTION

Children's building blocks suffer from a number of drawbacks. The biggest drawback is that they are too complicated to figure out for younger users. In particular, how to attach blocks to one another can be difficult for younger users to determine. This leads to frustration and abandonment of the block construction set.

For example, plastic and wood blocks are hard which presents a number of hazards. These range from minor, such as stepping on them causing discomfort, to very dangerous, such as choking hazards. Because of these hazards, plastic and wood blocks are unsuitable for young children.

Further, they can be difficult for young children to use. In particular, plastic blocks can be challenging to both assemble and disassemble for young children. Likewise, the lack of attachment between wood blocks can make it difficult for young children to assemble something that remains together. I.e., the lack of attachment makes structures assembled using wood block difficult because small perturbations can ruin the structural integrity, ruing the creation.

Moreover, those blocks can require timely disassembly in order to compactly store the blocks. In addition, the large numbers of shapes and sizes can make them suitable to construct a larger number of creations, but this can lead to confusion and frustration for younger users as well as make sorting and storing far more time consuming.

Accordingly, there is a need in the art for construction blocks that are simple for younger users to understand and be able to use. Further, there is a need in the art for construction blocks that don't present an injury hazard, that are light enough for young users, which can be sorted and stored easily and which are kid friendly.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a magnetic block set comprising a plurality of magnetically connectable magnetic block units. Each magnetic block unit includes a block body having one or more connection faces. Each connection face includes a plurality of connection face edges and a connection face surface and each connection face is a square. Each magnetic block unit also includes one or more magnetic elements on each connection face, each magnetic element having a magnetic polarity relative to the connection face that is the same as each of the other magnetic elements on the connection face. Each magnetic block unit further includes an outer shell covering both the block body and each of the one or more magnetic elements.

Another example embodiment includes a magnetic block set. The magnetic block set includes a first series of magnetically connectable magnetic block units. Each magnetic block unit in the first series of magnetically connectable magnetic block units includes a block body having one or more connection faces. Each connection face includes a plurality of connection face edges and a connection face surface and each connection face is a square. Each magnetic block unit in the first series of magnetically connectable magnetic block units also includes one or more magnetic elements on each connection face, each magnetic element having a north pole aligned perpendicularly to the connection face. Each magnetic block unit in the first series of magnetically connectable magnetic block units further includes an outer shell covering both the block body and each of the one or more magnetic elements, where the outer shell includes a first textile. The magnetic block set also includes a second series of magnetically connectable magnetic block units. Each magnetic block unit in the second series of magnetically connectable magnetic block units includes a block body having one or more connection faces. Each connection face includes a plurality of connection face edges and a connection face surface and each connection face is a square. Each magnetic block unit in the second series of magnetically connectable magnetic block units also includes one or more magnetic elements on each connection face, each magnetic element having a south pole aligned perpendicularly to the connection face. Each magnetic block unit in the second series of magnetically connectable magnetic block units further includes an outer shell covering both the block body and each of the one or more magnetic elements. The outer shell includes a second textile and the first textile is different than the first textile. Any connection face of the first series of magnetically connectable magnetic block units can mate with any connection face of the second series of magnetically connectable magnetic blocks.

Another example embodiment includes a magnetic block set. The magnetic block set includes a first series of magnetically connectable magnetic block units. Each magnetic block unit in the first series of magnetically connectable magnetic block units includes a block body having one or more connection faces. Each connection face includes a plurality of connection face edges and a connection face surface and each connection face is a square. Each magnetic block unit in the first series of magnetically connectable magnetic block units also includes four magnetic elements on each connection face. Each magnetic element having a north pole aligned perpendicularly to the connection face and placed 14 millimeters from each of two edges forming a corner. Each magnetic block unit in the first series of magnetically connectable magnetic block units further includes an outer shell covering both the block body and each of the one or more magnetic elements, where the outer shell includes a first textile. The first textile is a first color and fire retardant. Each magnetic element is attached to the interior of the outer shell. The magnetic block set also includes a second series of magnetically connectable magnetic block units. Each magnetic block unit in the second series of magnetically connectable magnetic block units includes a block body having one or more connection faces. Each connection face includes a plurality of connection face edges and a connection face surface and each connection face is a square. Each magnetic block unit in the second series of magnetically connectable magnetic block units also includes four magnetic elements on each connection face.

Each magnetic element having a south pole aligned perpendicularly to the connection face and placed 14 millimeters from each of two edges forming a corner. Each magnetic block unit in the second series of magnetically connectable magnetic block units further includes an outer shell covering both the block body and each of the one or more magnetic elements. The outer shell includes a second textile. The second textile is a second color, where the second color is different than the first color, and fire retardant. Each magnetic element is attached to the interior of the outer shell. Any connection face of the first series of magnetically connectable magnetic block units can mate with any connection face of the second series of magnetically connectable magnetic blocks.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
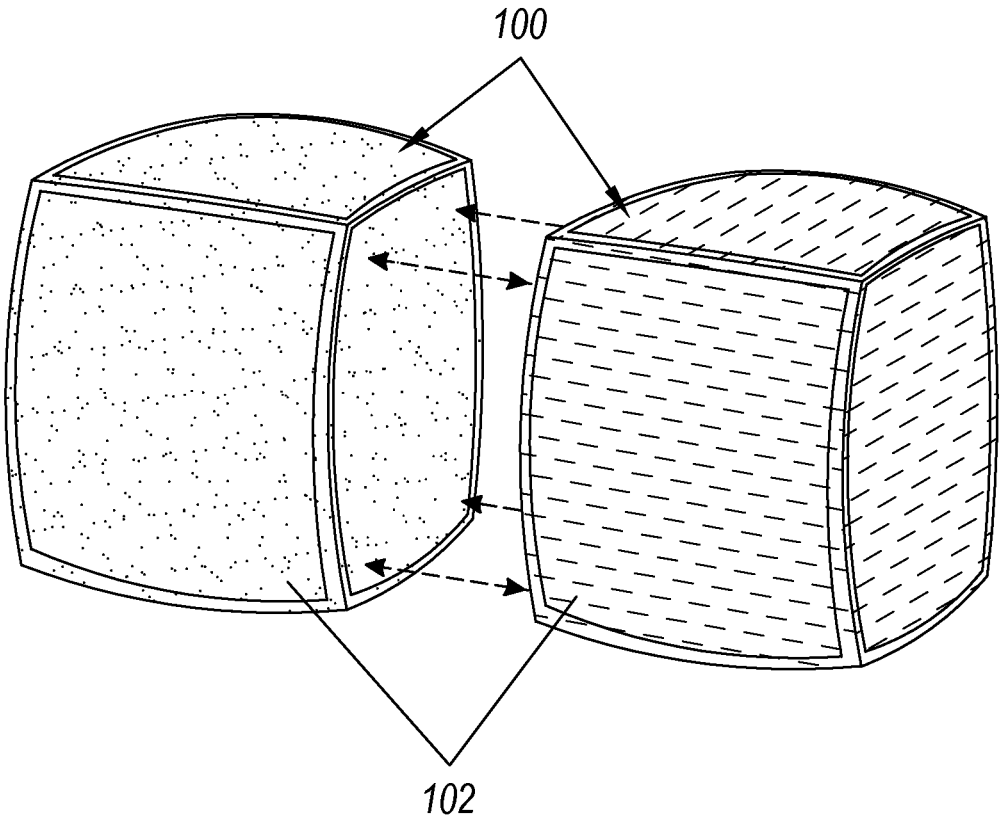
FIG. 1 illustrates an example of a magnetic block set comprising a plurality of magnetically connectable magnetic block units.

FIG. 1 illustrates an example of a magnetic block set comprising a plurality of magnetically connectable magnetic block units 100. The magnetic block unit 100 offers several advantages over other types of toy blocks. In particular, the magnetic block units 100 are soft, which helps prevent injuries, they are lightweight which allows younger children to use, they are stored easily, they are easy to clean up and they are kid friendly.

FIG. 1 shows that the magnetic block unit 100 can include an outer shell 102. The outer shell 102 can include a textile. The textile can include any flexible material made by creating an interlocking network of yarns or threads, which are produced by spinning raw fibers (from either natural or synthetic sources) into long and twisted lengths. Textiles are then formed by weaving, knitting, crocheting, knotting, tatting, felting, or braiding these yarns together.

The related words "fabric" and "cloth" and "material" are often used in textile assembly trades (such as tailoring and dressmaking) as synonyms for textile. However, there are subtle differences in these terms in specialized usage. A textile is any material made of interlacing fibers, including carpeting and geotextiles, which may not necessarily be used in the production of further goods, such as clothing and upholstery. A fabric is a material made through weaving, knitting, spreading, felting, stitching, crocheting or bonding that may be used in the production of further products, such as clothing and upholstery, thus requiring a further step of production. Cloth may also be used synonymously with fabric, but often specifically refers to a piece of fabric that has been processed or cut. Nevertheless, as used herein "textile," "fabric," "cloth," and "material" are synonyms unless otherwise specified.

To increase safety, the outer shell 102 can be made fire resistant. Although no fabric is fireproof, certain textiles resist fire better than other fabrics. Fire-resistant fabric, also known as flame-retardant fabric, is so designated based on the time it takes for the fabric to burn. Fire-resistant fabric may be naturally fire resistant because of its natural fiber weave, or treated with a fire-resistant chemical to resist heat and flames.

The following is a summary of flame retardancy terms as used in the textile industry:

"FR"—Fire Retardant (aka Flame Retardant)

Fabric that is certified as FR has been topically treated in an immersion process with a chemical fire retardant after the fabric has been woven. All cottons and other natural fibers certified as flame retardant are FR topically treated. Some synthetic fabrics are also topically treated. Because the treatment is topical, it will wear out in time, and repeated cleanings will cause the flame retardancy to dissolve sooner. Most flameproofing chemicals are water soluble and will Iso dissipate through dry cleaning. Draperies made from FR fabrics should be re-tested periodically for flame retardancy, as retreatment may be required. For this reason, "FR" flame retardancy is certified for only one year.

"IFR"—Inherently Fire Retardant (aka Inherently Flame Retardant)

"PFR"—Permanently Fire Retardant (aka Permanently Flame Retardant)

Fabric that has been certified as "IFR" or "PFR" has been woven from fibers that are noncombustible for the life of the fabric. For this reason, the fire retardancy of "IFR" and "PFR" fabrics will last for the life of the fabric and will not dissipate after cleaning.

"NFR"—Not Fire Retardant

"CBFR"—can be Made Fire Retardant

"CNFR"—Cannot be Made Fire Retardant

Fabric labeled "NFR" is not. If "CBFP" is indicated for a fabric, that fabric can be treated for fire retardancy. Such treatment would include topical treatment in an immersion process, making the fabric "FR." Some synthetics can be made fire retardant. IF "CNFR" is indicated for a fabric, that fabric cannot be treated for fire retardancy and, as such, should not be used in public venues. Among the types of fabrics that cannot be made fire retardant are certain synthetic and/or metallic fabrics.

What is the NFPA 701 Test?

Fabrics used in most public spaces (including schools, churches, auditoriums, theatres, and more.) is required by law in many states and cities to be certified as flame retardant, according to standards developed by the National Fire Protection Association (NFPA). NFPA has various standards depending on how the fabric will be used. In the case of draperies, curtains, and similar hanging textiles, the standard that applies is NFPA 701: Standard Methods of Fire Tests for Flame Propagation of Textiles and Films. This test measures the flammability of a fabric when it is exposed to specific sources of ignition.

NFPA 701 (Small Scale) testing measures the ignition resistance of a fabric after it is exposed to a flame for 12 seconds. The flame, char length, and flaming residue are recorded.

The fabric will pass the test if all samples meet the following criteria:

An after flame of less than 2.0 seconds

A char length of less than 6.5"

The specimen does not continue to flame after reaching the floor of the test chamber Fabric certified as flame retardant is certified to have been tested and passed the NFPA 701 test.

Below are some examples of fibers that can be used in a fire-resistant textiles.

Natural Fibers

Wool is generally considered the most flame-resistant natural fiber, because it is difficult to ignite, and flames are often extinguished in the fibers. Natural fibers, such as silk, cotton and wool, are more susceptible to fire than manufactured fibers, but cloth manufacturing techniques can improve their fire resistance. Natural fibers can be treated with a chemical solution that improves flame resistance. When a material made of natural fibers is constructed with a tight weave, the material provides improved flame resistance.

Acrylic, Polyester and Nylon

Synthetic acrylic, polyester and nylon fabrics can be hazardous when they burn, because the materials can melt and cause burns on the skin when used as clothing fabrics. Despite this danger, these synthetic fabrics are considered fire-resistant fabrics, because they resist ignition at much higher temperatures than natural fibers. Synthetic materials can also be treated with fire-resistant chemicals to increase their ability to withstand high temperatures.

Kevlar and Nomex

Strong, heat-resistant aramid fibers are used in the brand-name fabrics Kevlar and Nomex. The fabrics are well known for their uses in body armor and bulletproof vests worn by members of law enforcement. Kevlar and similarly manufactured fabrics are inherently fire resistant, more than any other type of fabric, and they are often used to make heat-resistant gloves for welders and glass blowers and protective clothing for firefighters.

The outer shell 102 is color coded, patterned or textured to allow for easy determination of which magnetic block units 100 can mate with one another. I.e., in order to make sure that the magnetic block units 100 align with and can adhere to one another the blocks of Because magnets have polarity, one type of magnetic block unit 100 will be "negative" (i.e., the negative pole of all magnets will point outward) and the other type of magnetic block unit 100 will be "positive" (i.e., the positive pole of all magnets will point outward) and the color, pattern, or texture will allow a user to easily identify which is which. For example, the magnetic block units 100 can include gray blocks which are of one polarity and blue blocks with the opposite polarity. One of skill in the art will appreciate that any appropriate method of distinguishing magnetic block units 100 of different polarity allows even young children to easily identify which magnetic block units 100 can be stuck to one another.

While blocks can be manufactured which will always stick to another block (e.g., if half of the magnets are arranged in one orientation while the other half of the magnets are arranged in the other orientation) those blocks have a problem in that they require that all blocks be attached to one another in a preset manner. That is, the blocks may need to be rotated through one or more axes in order to be secured to one another. This makes attaching blocks a more difficult task and makes the blocks less appealing to younger children. In addition, such an arrangement makes some shapes difficult or impossible to assemble. Therefore, arranging all magnets in a single polarity and making the polarity clear via some feature of the outer shell 102 can be critical to make the magnetic block units 100 usable by younger children and provide for a greater number of possible constructions.

Figure 2:
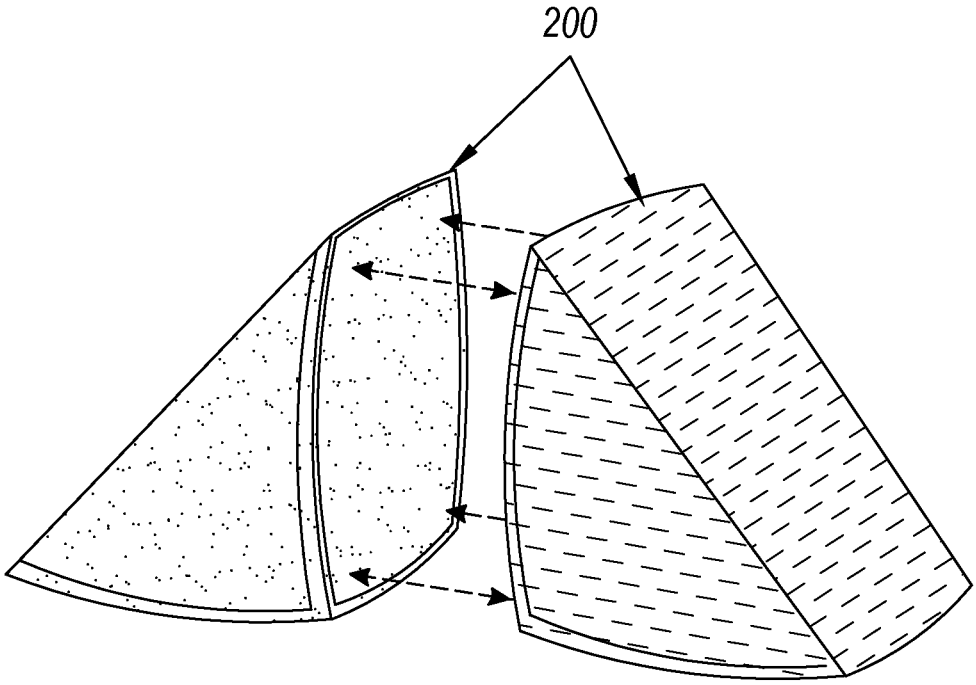
FIG. 2 illustrates an alternative example of a magnetic block unit.

FIG. 2 illustrates an alternative example of a magnetic block unit 200. The shape of the magnetic block unit 200 is triangular, as opposed to the cubic shape of the magnetic block unit 100 of FIG. 1. One of skill in the art will appreciate that other shapes are contemplated herein and that any desired shape can be created. The magnetic block unit 200 is the same size and shape as the magnetic block unit 100 cut along a line between two opposing diagonals.

The alternative example of a magnetic block unit 200 can allow a user to create other shapes. That is, the alternative example of a magnetic block unit 200 increases the number of creations that are possible. Likewise, the alternative example of a magnetic block unit 200 includes many of the same features as the magnetic block unit 100 of FIG. 1. For example, the magnetic block unit 200 can include an outer shell 202 with the same features as the outer shell 102 including color coding to make possible attachment easy to recognize.

Figure 3:
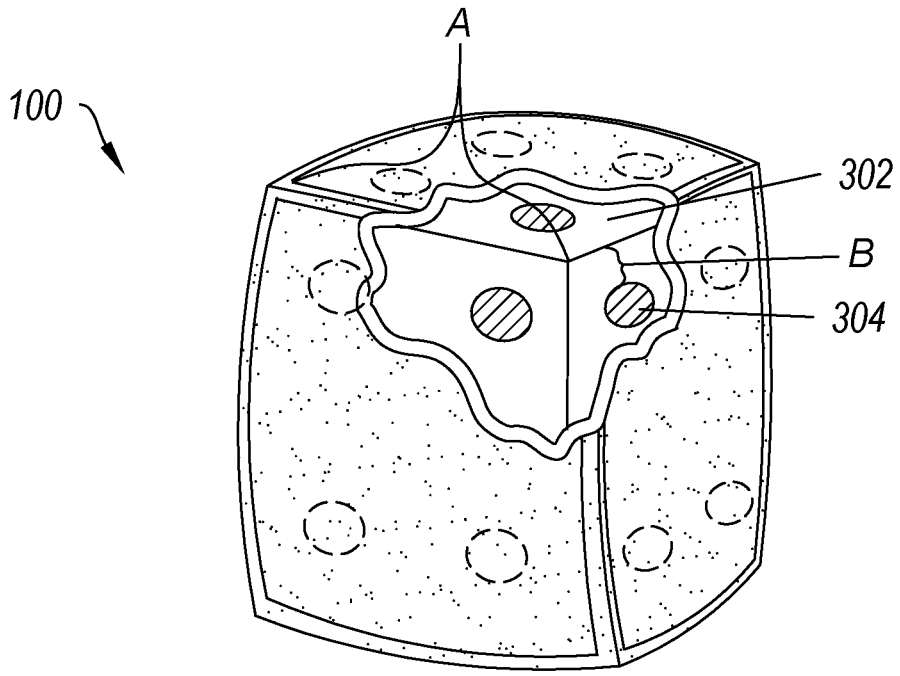
FIG. 3 illustrates an example of a partial cut-away view of a magnetic block unit.

FIG. 3 illustrates an example of a partial cut-away view of a magnetic block unit 100. One of skill in the art will appreciate that many or all of the features discussed with regard to the magnetic block unit 100 in regard to FIG. 3 are also present in the alternative magnetic block unit 200 of FIG. 2 with any differences noted below.

FIG. 3 shows that each magnetic block unit 100 can include a foam core 302. The foam core 102 is deformable, which allows a user to grab the block easily, even if the user is young and has small hands. The foam core 102 also makes the magnetic block unit 100 soft. This is critical to ensure that users do not get injured if he/she is hit by a magnetic block unit 100.

The foam core 302 can be formed of any suitable material. For example, the foam core 302 can be composed of polyester, rubber and polyurethane. Foam is an object formed by trapping pockets of gas in a solid. Solid foams can be closed-cell or open-cell. In closed-cell foam, the gas forms discrete pockets, each completely surrounded by the solid material. In open-cell foam, gas pockets connect to each other. A bath sponge is an example of an open-cell foam: water easily flows through the entire structure, displacing the air. A camping mat is an example of a closed-cell foam: gas pockets are sealed from each other so the mat cannot soak up water.

Additionally, the size of the foam core can be critical to allow a user to handle the magnetic block unit 100. For example, very young users don't do well with small blocks (which include other hazards such as a choking hazard) or blocks that are too large. Likewise, if the magnetic block unit 100 is too small, then it takes a large number of blocks to create a desired creation; however, blocks that are too large lead to creations that are too big and become unwieldy. Therefore, the size of the foam core can be between 102 and 152 millimeters on each square face (as shown in measurement A). For example, the size of the foam core can be approximately 127 millimeters on each side of square face.

FIG. 3 also shows that the magnetic block unit 100 can include a series of magnetic elements 304. On each side, the magnetic block unit 100 includes four magnetic elements 304 which all have polarity in the same direction. I.e., each face has a magnetic element 304 near each corner with a polarity that matches all other magnetic elements 304 in the magnetic block unit 100. The placement of the magnetic elements 304 can be critical to ensure that the blocks attach to one another. In particular, if the magnetic elements 304 are not placed with precision, then some of the magnetic elements 304 will not line up with magnetic elements 304 in other blocks and attachment strength will be too weak to be effective. That is, if the magnetic elements 304 aren't placed with precision, then one or more of the four magnetic elements 304 on any face will not have a companion magnetic element 304 and the attachment strength will be very low, making the use of the magnetic block units 100 ineffective for building a project. Therefore, the magnetic elements 304 need to be place with a high amount of precision. For example, the magnets can be in the corner approximately 14 millimeters from the two edges forming a corner of the face (as shown in measurement B). The magnets are attached to either the outside of the foam or the inside of the fabric. The tolerances on that placement can be quite low, as explained above. Therefore, in each dimension, the placement needs to be within 1 millimeters.

Additionally, the magnetic elements 304 should be placed with rotational symmetry. Rotational symmetry, also known as radial symmetry, is the property a shape has when it looks the same after some rotation by a partial turn. An object's degree of rotational symmetry is the number of distinct orientations in which it looks exactly the same for each rotation. Therefore, if a face of the magnetic block unit 100 is rotated (usually about the center point of the face) then the magnetic elements 304 will come back to a place where they can align with adjoining blocks. This usually means that the magnetic elements 304 are placed with rotational symmetry of degrees that are powers of two (e.g., 2, 4, 8, 16, etc.).

In the case of the alternative magnetic block unit 200 of FIG. 2, the magnets may be present only on the square sides and may not be on the rectangular (long) side of the magnetic block unit 200. This is because those magnetic elements 304, if in the corners, would not be in a shape that matches the shape of a matching block. I.e., if the magnets are placed in the same position relative to the corners of the rectangular side of the alternative block, then they would not all match the placement of magnetic elements 304 on the square side of either a magnetic block unit 100 or alternative magnetic block unit 100.

One of skill in the art will appreciate that the strength of the magnetic elements 304 can be critical to ensure that the magnetic block units 100 can be used to create a desired construction. In particular, if the magnetic elements 304 are too strong, then it can make the magnetic block units 100 difficult to separate from one another. Likewise, if the magnetic elements 304 are too strong, then the magnetic field of each magnet can disrupt the placement of the magnetic elements 304. If the magnetic elements 304 are too weak, the magnetic block units 100 won't hold to one another. Therefore, the magnetic elements 304 can be rated between N35 and N40, preferably around N38. As used in the specification and the claims, the term approximately shall mean that the value is within 10% of the stated value, unless otherwise specified.

The magnetic elements 304 can include any magnetic material. A magnet is a material or object that produces a magnetic field. This magnetic field is invisible but is responsible for the most notable property of a magnet: a force that pulls on other ferromagnetic materials, such as iron, and attracts or repels other magnets. Magnets are generally divided into two types:

Permanent magnet—A permanent magnet is an object made from a material that is magnetized and creates its own persistent magnetic field. An everyday example is a refrigerator magnet used to hold notes on a refrigerator door. Materials that can be magnetized, which are also the ones that are strongly attracted to a magnet, are called ferromagnetic (or ferrimagnetic). These include the elements iron, nickel and cobalt and their alloys, some alloys of rare-earth metals, and some naturally occurring minerals such as lodestone. Although ferromagnetic (and ferrimagnetic) materials are the only ones attracted to a magnet strongly enough to be commonly considered magnetic, all other substances respond weakly to a magnetic field, by one of several other types of magnetism.

Ferromagnetic materials—Ferromagnetic materials can be divided into magnetically "soft" materials like annealed iron, which can be magnetized but do not tend to stay magnetized, and magnetically "hard" materials, which do. Permanent magnets are made from "hard" ferromagnetic materials such as alnico and ferrite that are subjected to special processing in a strong magnetic field during manufacture to align their internal microcrystalline structure, making them very hard to demagnetize. To demagnetize a saturated magnet, a certain magnetic field must be applied, and this threshold depends on coercivity of the respective material. "Hard" materials have high coercivity, whereas "soft" materials have low coercivity. The overall strength of a magnet is measured by its magnetic moment or, alternatively, the total magnetic flux it produces. The local strength of magnetism in a material is measured by its magnetization.

The magnetic elements 304 can be solid, flexible, electronic, etc. For example, the magnetic elements 304 can be solid cylindrical magnets, which makes placing the magnetic element 304 with a particular polarity easy. Likewise, a flexible magnet can be used as the magnetic element 304 which allows more adjustment during manufacturing.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A magnetic block set, the magnetic block set comprising:

a first series of magnetically connectable magnetic block units, each magnetic block unit in the first series of magnetically connectable magnetic block units comprising:

a block body having one or more connection faces, wherein:

the block body includes:

a closed cell foam core, wherein the closed cell foam core is composed of:

polyester;

rubber; and urethane;

each connection face includes a plurality of connection face edges and a connection face surface; and each connection face is a square;

two or more magnetic elements on each connection face, each of the two or more magnetic elements:
having a north pole aligned perpendicularly to the connection face; and
rated between N35 and N40;
an outer shell covering both the block body and each of the two or more magnetic elements, wherein the outer shell includes a first textile; and
a first indicator on the outer shell, wherein the first indicator:
allows a user to identify the polarity of the two or more magnetic elements in the first series of magnetically connectable magnetic block units; and
includes at least one of:
color;
pattern;
texture; or
fabric type; and
a second series of magnetically connectable magnetic block units, each magnetic block unit in the second series of magnetically connectable magnetic block units comprising:
a block body having one or more connection faces, wherein:
the block body includes:
a closed cell foam core, wherein the closed cell foam core is composed of:
polyester:
rubber; and
urethane;
each connection face includes a plurality of connection face edges and a connection face surface; and
each connection face is a square;
two or more magnetic elements on each connection face, each of the two or more magnetic elements:
having a south pole aligned perpendicularly to the connection face; and
rated between N35 and N40
an outer shell covering both the block body and each of the two or more magnetic elements, wherein:
the outer shell includes a second textile; and
the outer shell includes a second indicator, wherein the second indicator:
allows a user to identify the polarity of the two or more magnetic elements in the second series of magnetically connectable magnetic block units;
is different that the first indicator; and
includes at least one of:
color;
pattern;
texture; or
fabric type; and
wherein any connection face of the first series of magnetically connectable magnetic block units can mate with any connection face of the second series of magnetically connectable magnetic blocks.

2. The magnetic block set of claim 1, wherein:
the first indicator includes a first color;
the second indicator includes a second color; and
the first color is different than the second color.

3. The magnetic block set of claim 2, wherein the first textile is blue and the second textile is gray.

4. The magnetic block set of claim 1, wherein:
the first indicator includes a first pattern on the first textile;
the second indicator includes a second pattern on the second textile; and
the first pattern is different than the second pattern.

5. The magnetic block set of claim 1, wherein:
the first indicator includes a first texture;
the second indicator includes a second texture; and
the first texture is different than the second texture.

6. The magnetic block set of claim 1, wherein:
the first textile includes a first fabric type;
the second textile includes a second fabric type; and
the first fabric type is different than the second fabric type.

7. A magnetic block set, the magnetic block set comprising:
a first series of magnetically connectable magnetic block units, each magnetic block unit in the first series of magnetically connectable magnetic block units comprising:
a block body having one or more connection faces, wherein:
the block body includes:
a closed cell foam core, wherein the closed cell foam core is composed of:
polyester;
rubber; and
urethane;
each connection face includes a plurality of connection face edges and a connection face surface; and
each connection face is a square;
four magnetic elements on each connection face, wherein each magnetic element:
includes a north pole aligned perpendicularly to the connection face;
is rated between N35 and N40; and
is placed 14 millimeters from each of two edges forming a corner;
an outer shell covering both the block body and each of the four magnetic elements, wherein the outer shell includes a first textile, wherein the first textile:
includes a first visual indicator, wherein the first visual indicator is configured to allow a user to identify the polarity of the magnetic block unit on sight by indicating that the magnetic block unit is part of the first series of magnetically connectable magnetic block units; and
is fire retardant;
wherein each magnetic element is attached to the interior of the outer shell;
a second series of magnetically connectable magnetic block units, each magnetic block unit in the second series of magnetically connectable magnetic block units comprising:
a block body having one or more connection faces, wherein:
the block body includes:
a closed cell foam core, wherein the closed cell foam core is composed of:
polyester;
rubber; and
urethane;
each connection face includes a plurality of connection face edges and a connection face surface; and
each connection face is a square;
four magnetic elements on each connection face, wherein each magnetic element:
includes a south pole aligned perpendicularly to the connection face;
is rated between N35 and N40; and
is placed 14 millimeters from each of two edges forming a corner;

an outer shell covering both the block body and each of the four magnetic elements, wherein the outer shell includes a second textile, wherein the second textile: includes a second visual indicator, wherein:

the second visual indicator is configured to allow a user to identify the polarity of the magnetic block unit on sight by indicating that the magnetic block unit is part of the second series of magnetically connectable magnetic block units; and the second visual indicator is different than the first visual indicator; and is fire retardant;

wherein each magnetic element is attached to the interior of the outer shell; and wherein any connection face of the first series of magnetically connectable magnetic block units can mate with any connection face of the second series of magnetically connectable magnetic blocks.

8. The magnetic block set of claim 7, wherein the magnetic elements are rated N38.

9. The magnetic block set of claim 7, wherein each magnetic block unit in the first series of magnetically connectable magnetic block units is cubical.

10. The magnetic block set of claim 7, wherein each magnetic block unit in the first series of magnetically connectable magnetic block units is triangular.

* * * * *